US012331542B2

(12) United States Patent
Wang et al.

(10) Patent No.: US 12,331,542 B2
(45) Date of Patent: Jun. 17, 2025

(54) SWIMMING POOL CLEANING ROBOT

(71) Applicant: Shenzhen Aiper Intelligent Co., Ltd., Shenzhen (CN)

(72) Inventors: Yang Wang, Shenzhen (CN); Xueliang Yu, Shenzhen (CN); Chunlin Cheng, Shenzhen (CN)

(73) Assignee: Shenzhen Aiper Intelligent Co., Ltd., Shenzhen (CN)

( * ) Notice: Subject to any disclaimer, the term of this patent is extended or adjusted under 35 U.S.C. 154(b) by 475 days.

(21) Appl. No.: 17/956,460

(22) Filed: Sep. 29, 2022

(65) Prior Publication Data

US 2024/0052661 A1 Feb. 15, 2024

(30) Foreign Application Priority Data

Aug. 12, 2022 (CN) ..... 202222134270.4

(51) Int. Cl.
*E04H 4/16* (2006.01)

(52) U.S. Cl.
CPC ..... *E04H 4/1654* (2013.01); *E04H 4/16* (2013.01); *E04H 4/1636* (2013.01)

(58) Field of Classification Search
CPC ..... E04H 4/16; E04H 4/1663; E04H 4/1654; E04H 4/1636
See application file for complete search history.

(56) References Cited

U.S. PATENT DOCUMENTS

2007/0067930 A1* 3/2007 Garti ..... E04H 4/1654 15/1.7

FOREIGN PATENT DOCUMENTS

WO WO-2009095626 A2 * 8/2009 ..... E04H 4/1654

* cited by examiner

*Primary Examiner* — Michael D Jennings
(74) *Attorney, Agent, or Firm* — Stein IP, LLC

(57) ABSTRACT

A swimming pool cleaning robot includes a bottom shell, a sealed tank and a first counterweight block, the sealed tank is provided inside the bottom shell, and the first counterweight block is provided inside the sealed tank. The first counterweight block is provided in a sealed tank of a swimming pool cleaning robot without additionally providing an installation space for the first counterweight block, making full use of more difficult to use inside the swimming pool cleaning robot, and effectively reducing the space required inside the swimming pool cleaning robot while ensuring that the counterweight block meets the requirements, thereby reducing the volume of the whole machine. Besides, it does not require flattening of the bottom shell of the swimming pool cleaning robot, so that the bottom shell can be designed in a variety of shapes to enrich the diversity of the swimming pool cleaning robot.

9 Claims, 4 Drawing Sheets

SWIMMING POOL CLEANING ROBOT

TECHNICAL FIELD

The present invention relates to the technical field of pool cleaning apparatus and in particular to a pool cleaning robot.

BACKGROUND ART

A swimming pool is a place for people to swim and needs to be regularly cleaned. At present, people often clean the swimming pool with swimming pool cleaning robots to liberate labor force and improves the quality of life.

However, the current swimming pool cleaning robot in the market is generally provided with a flat counterweight block integrated with a swimming pool robot bottom shell. This structure is difficult to adapt to swimming pool robots with different bottom shells, and the inner space of the swimming pool robot is not fully utilized, so that the swimming pool robot needs a large inner space.

SUMMARY OF THE INVENTION

A technical problem to be solved by the present invention is to provide a swimming pool cleaning robot that makes full use of the inner space.

In order to solve the above technical problem, the technical solution adopted by the present invention is: a swimming pool cleaning robot comprising a bottom shell, a sealed tank and a first counterweight block, wherein the sealed tank is provided inside the bottom shell, and the first counterweight block is provided inside the sealed tank.

Further, a first counterweight block tank is also provided in the sealed tank, the first counterweight block is provided in the first counterweight block tank, and the first counterweight block tank is integrally formed with the sealed tank.

Further, an outside wall of the first counterweight block tank is provided with a reinforcing rib.

Further, a first tank cover for closing the first counterweight block tank is included.

Further, the sealed tank comprises a matching tank body and a tank cover, wherein an inner side of the tank cover is provided with an abutting column, and the abutting column abuts the first tank cover.

Further, a circuit board assembly, a battery pack, and two motors are provided within the sealed tank, and the first counterweight block is located in the center of the area enclosed by the circuit board assembly, the battery pack, and the two motors.

Further, the bottom shell is provided with an even number of second counterweight blocks symmetrically distributed around the center of the sealed tank.

Further, the bottom shell is provided with a second counterweight block tank for mounting the second counterweight block.

Further, a second tank cover for closing the second counterweight block tank is included.

Further, a support rib is provided at the bottom inside the second counterweight block tank, the support rib is connected to the bottom shell, and the top surface of the support rib is a support plane for contacting the second counterweight block.

The advantageous effect of the present invention is that providing the first counterweight block in the sealed tank of the swimming pool cleaning robot can make full use of the difficult space in the swimming pool cleaning robot, ensure that the counterweight block meets the requirements, and effectively reduce the space required in the swimming pool cleaning robot, thus reducing the volume of the whole machine. In addition, the first counterweight block provided in the sealed tank does not require flattening of the bottom shell of the swimming pool cleaning robot, so that the bottom shell can be designed in a variety of shapes to enrich the diversity of the swimming pool cleaning robot.

DESCRIPTION OF REFERENCE NUMERALS

Figure 1:
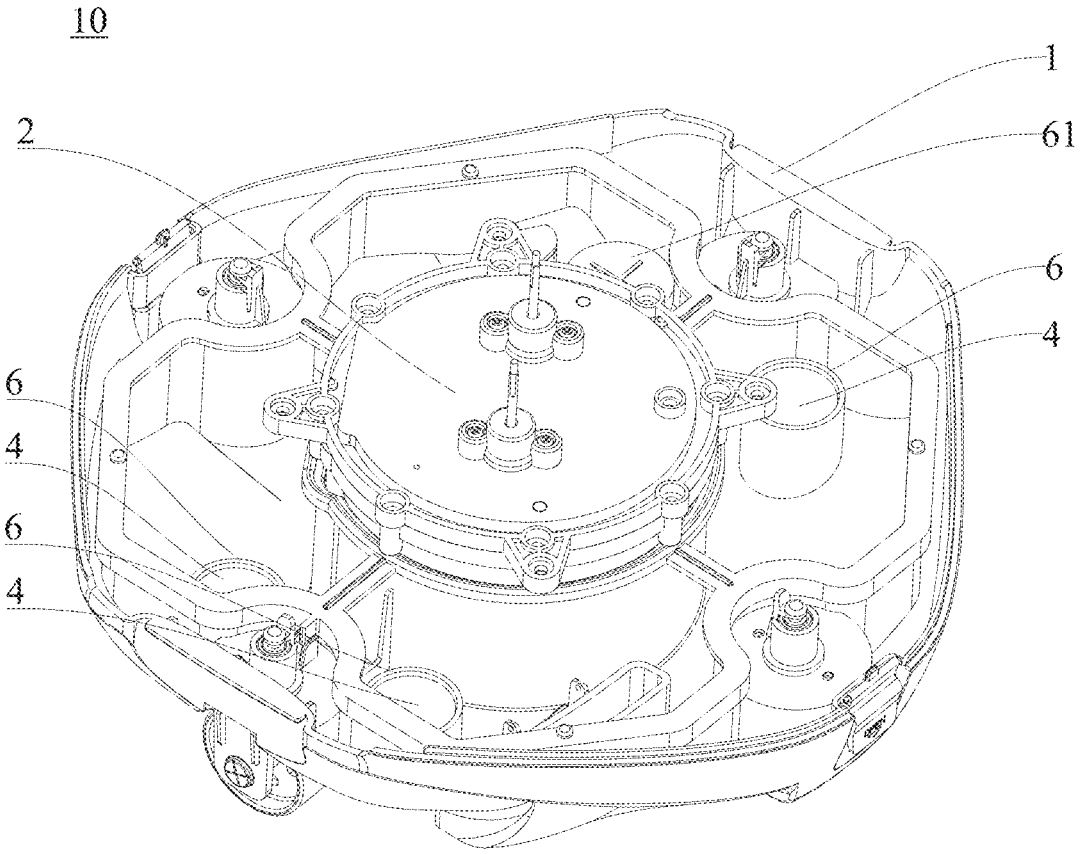
FIG. 1 is a schematic view showing an internal structure of a swimming pool cleaning robot according to an embodiment of the present invention.

10. swimming pool cleaning robot
1. bottom shell;
2. sealed tank; 21. tank body; 22. tank cover; 23. abutting column; 24. circuit board assembly; 25. battery pack; 26. motor;
3. first counterweight block;
4. second counterweight block;
5. first counterweight block tank; 51. reinforcing rib; 52. first tank cover;
6. second counterweight block tank; 61. second tank cover; 62. support rib.

DETAILED DESCRIPTION OF THE INVENTION

In order to explain the technical contents, the objects, and the effects of the present invention in detail, the embodiments will be described below with reference to the accompanying drawings.

With reference to FIGS. 1 to 4, a swimming pool cleaning robot 10 comprises a bottom shell 1, a sealed tank 2 and a first counterweight block 3, wherein the sealed tank 2 is provided inside the bottom shell 1, and the first counterweight block 3 is provided inside the sealed tank 2.

As apparent from the above description, the advantageous effect of the present invention is that a first counterweight block 3 in a sealed tank 2 of a swimming pool cleaning robot 10 is provided without additionally providing an installation space for the first counterweight block 3, making full use of more difficult to use inside the swimming pool cleaning robot 10, and effectively reducing the space required inside the swimming pool cleaning robot 10 while ensuring that the counterweight block meets the requirements, thereby reducing the volume of the whole machine. In addition, the first counterweight block 3 provided in the sealed tank 2 does not require flattening of the bottom shell of the swimming pool cleaning robot 10, so that the bottom shell can be designed in a variety of shapes to enrich the diversity of the swimming pool cleaning robot 10.

Further, a first counterweight block tank 5 is also provided in the sealed tank 2, the first counterweight block 3 is provided in the first counterweight block tank 5, and the first counterweight block tank 5 is integrally formed with the sealed tank 2.

It can be seen from the above-mentioned description that the first counterweight block tank and the sealed tank 2 are integrally machined and formed without additional fixing parts, and the structure thereof is simple and easy to manufacture.

Further, the outside wall of the first counterweight block tank 5 is provided with a reinforcing rib 51.

It can be seen from the above-mentioned description that the reinforcing rib structure can improve the strength of the first counterweight block tank and reduce the risk of damage to the first counterweight block tank.

Further, a first tank cover 52 for closing the first counterweight block tank 5 is included.

It can be seen from the above description that the first tank cover is used for fixing the first counterweight block in the first counterweight block tank.

Further, the sealed tank 2 comprises a matching tank body 21 and a tank cover 22, wherein the inner side of the tank cover 22 is provided with an abutting column 23, and the abutting column 23 abuts the first tank cover 52.

It can be seen from the above-mentioned description that the abutting column can press the first tank cover so as to prevent the first tank cover from being opened accidentally, and when the first tank cover presses against the first counterweight block, the abutting column can also transmit a pressing force to the first counterweight block so as to ensure that the first counterweight block is not in the first counterweight block tank.

Further, a circuit board assembly 24, a battery pack 25 and two motors 26 are provided in the sealed tank 2, and the first counterweight block 3 is located at the center of the area surrounded by the circuit board assembly 24, the battery pack 25 and the two motors 26.

It can be seen from the above description that this arrangement can make full use of the space of the sealed tank and achieve the provision of the counterweight block in the sealed tank without increasing the volume of the sealed tank.

Further, the bottom shell 1 is provided with an even number of second counterweight blocks 4 symmetrically distributed around the center of the sealed tank 2.

It can be seen from the above description that the symmetrical distribution of the second counterweight block around the center of the sealed tank can make the center of gravity of the apparatus as close as possible to the geometrical center of the apparatus and make the apparatus more stable in operation.

Further, the bottom shell 1 is provided with a second counterweight block tank 6 for mounting the second counterweight block 4.

Further, a second tank cover 61 for closing the second counterweight block tank 6 is also included.

It can be seen from the above description that the second tank cover 61 is used for fixing the second counterweight block in the second counterweight block tank.

Further, a support rib 62 is provided at the inner bottom of the second counterweight block tank 6, the support rib 62 is connected to the bottom shell 1, and the top surface of the support rib 62 is a support plane for contacting the second counterweight block 4.

It can be seen from the above-mentioned description that the support rib supports the bottom surface of the second counterweight block tank as a plane, so that the installation of the second counterweight block and the forming and processing of the second counterweight block can be more convenient.

Embodiment 1

With reference to FIGS. 1 to 4, an embodiment of the present invention is a swimming pool cleaning robot 10 comprising an upper cover, a bottom shell 1, a sealed tank 2 and a first counterweight block 3, wherein the bottom shell 1 is connected to the upper cover, the sealed tank 2 is arranged inside the bottom shell 1, and the first counterweight block 3 is arranged inside the sealed tank 2.

Figure 2:
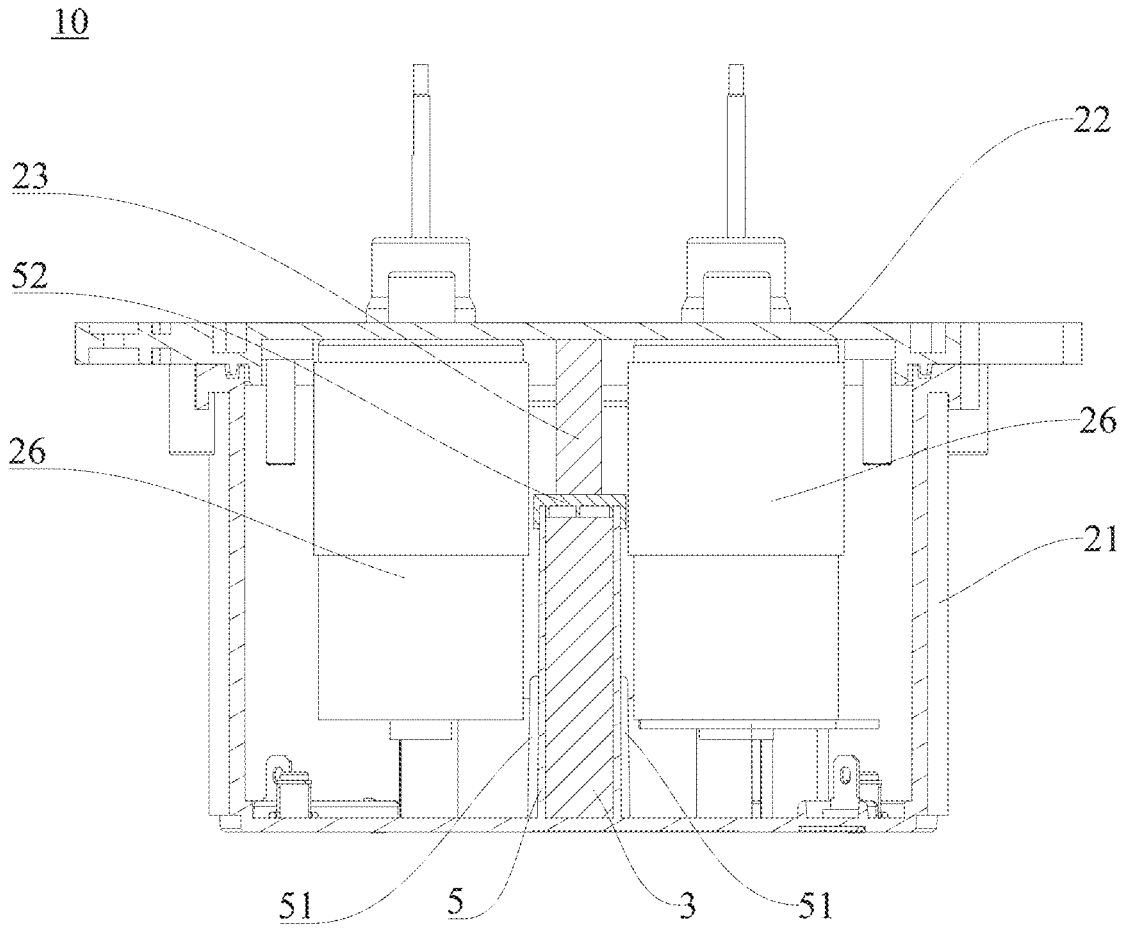
FIG. 2 is a cross-sectional view of a sealed tank in a swimming pool cleaning robot according to an embodiment of the present invention.

With reference to FIG. 2, in order to facilitate the positioning and installation of the first counterweight block 3, a first counterweight block tank 5 is further provided in the sealed tank 2, and the first counterweight block 3 is provided in the first counterweight block tank 5. In this embodiment, the first counterweight block tank 5 is integrally processed and formed with the sealed tank 2, and no additional fixing part is required. In other embodiments, the first counterweight block tank 5 and the sealed tank 2 can also be connected and fixed together after being separately processed.

Figure 3:
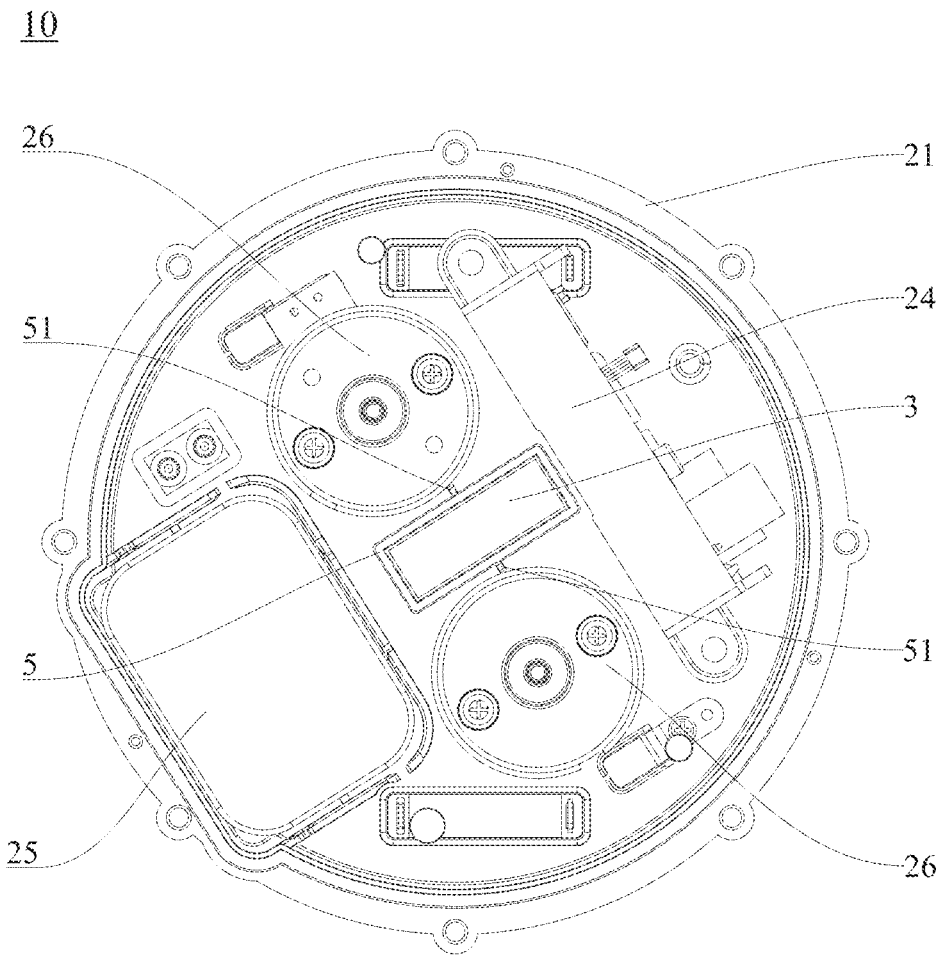
FIG. 3 is a top view of the interior of a sealed tank in a swimming pool cleaning robot according to an embodiment of the present invention.

Referring to FIGS. 2 and 3, optionally, the outside wall of the first counterweight block tank 5 is provided with a reinforcing rib 51. The reinforcing rib 51 is provided between the bottom shell 1 and the outside wall of the first counterweight block tank 5. Optionally, the reinforcing rib may be a triangular block or a trapezoidal block. In this embodiment, the reinforcing rib is a trapezoidal block.

As shown in FIG. 2, the first counterweight block tank 5 further comprises a first tank cover 52 for closing the first counterweight block tank 5, wherein one face of the first tank cover 52 adjacent to the first counterweight block 3 is provided with a boss, and the boss is pressed against the first counterweight block 3, so that the first counterweight block 3 cannot shake in the first counterweight block tank 5. Optionally, the first counterweight block tank 5 is connected with the first tank cover 52 in a snap-fit connection, an adhesive connection, a threaded connection or other manners, and in the embodiment, the first counterweight block tank 5 is connected with the first tank cover 52 in an adhesive sealing manner.

As shown in FIG. 2, the sealed tank 2 of the first counterweight block comprises a tank body 21 and a tank cover 22 in cooperation, and in this embodiment, in order to prevent the first tank cover 52 from being loosened when the swimming pool cleaning robot 10 is subjected to strong vibration or impact, an abutting column 23 is provided on the inner side of the tank cover 22, and the abutting column 23 abuts against the first tank cover 52. In order to facilitate manufacturing, the tank body 21 is integrally formed with the bottom shell 1. In the embodiment, the tank body 21 and the bottom shell 1 are integrally injection-molded as a one-piece structure. In other embodiments, the tank body 21 and the bottom shell 1 may also be of a split structure.

As shown in FIG. 3, in particular, the sealed tank 2 is provided with a circuit board assembly 24, a battery pack 25 and two motors 26, and in the embodiment, in order to make full use of the space of the sealed tank 2, a counterweight block is provided in the sealed tank 2 without increasing the volume of the sealed tank 2, and the first counterweight block 3 is located in the center of the area surrounded by the circuit board assembly 24, the battery pack 25 and the two motors 26.

Figure 4:
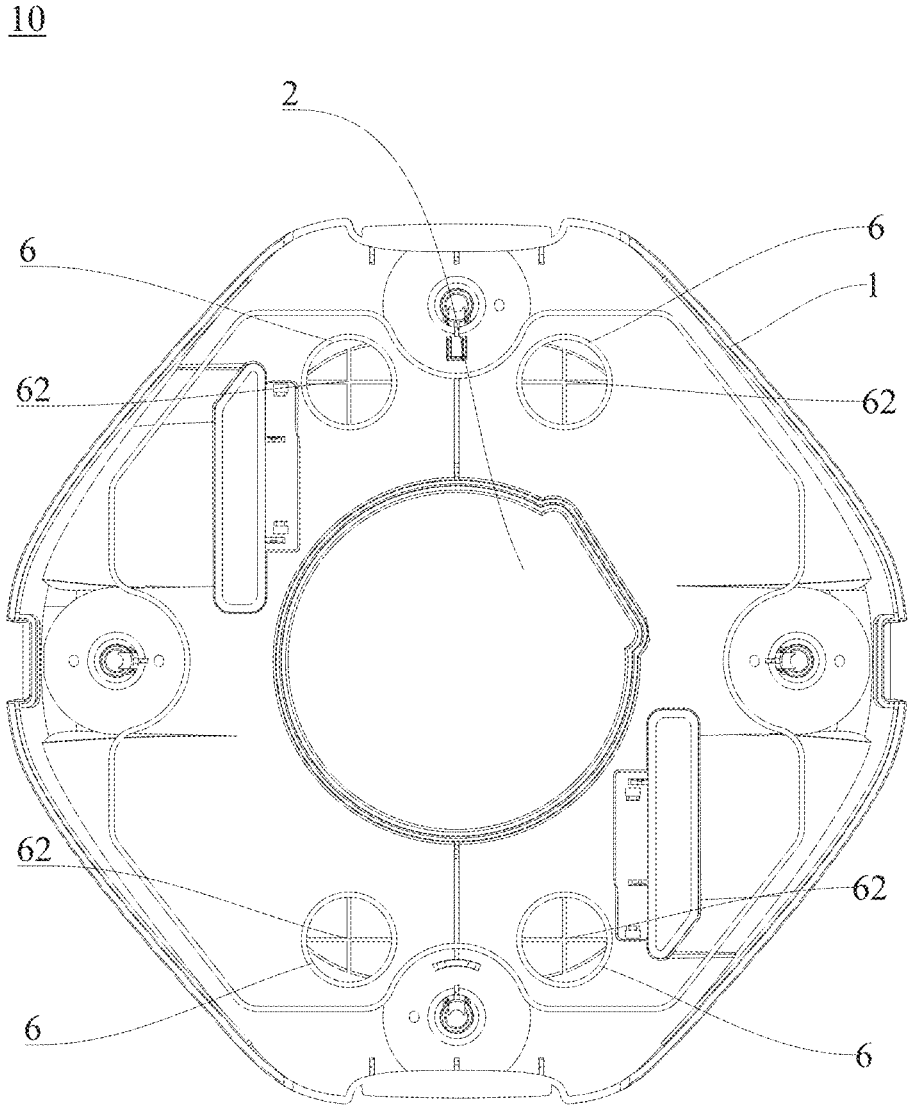
FIG. 4 is a top view of a bottom shell in a swimming pool cleaning robot according to an embodiment of the present invention.

With reference to FIGS. 1 and 4, in order to make the center of gravity of the apparatus closer to the geometric center and make the operation of the apparatus more stable, in the embodiment, the bottom shell 1 is provided with four second counterweight blocks 4 symmetrically distributed around the center of the sealed tank 2; in other embodiments, the bottom shell 1 may be provided with two second counterweight blocks 4, wherein the two second counterweight blocks 4 are symmetrically distributed with respect to the sealed tank 2, and the centers of gravity of the two second counterweight blocks 4 and the sealed tank 2 are on the same straight line.

Referring to FIGS. 1 and 4, the bottom shell 1 is further provided with a second counterweight block tank 6 for mounting the second counterweight block 4, and the second counterweight block tank 6 further comprises a second tank cover 61 for closing the second counterweight block tank 6 to prevent the second counterweight block 4 from shaking inside the second counterweight block tank 6. Optionally, the connection mode of the second counterweight block tank 6 and the second tank cover 61 is a snap connection, a threaded connection or other connection modes, and in the embodiment, the second counterweight block tank 6 and the second tank cover 61 are adhesively connected.

As shown in FIG. 4, since the bottom surface of the second counterweight block tank 6 is a curved surface, in order to facilitate the processing and installation of the second counterweight block 4, in the embodiment, a support rib 62 is provided at the inner bottom of the second counterweight block tank 6, the support rib 62 connects the bottom shell 1 and the inner side surface of the second counterweight block tank 6, and the top surface of the support rib 62 is a support plane for contacting the second counterweight block 4. It can be understood that the support rib 62 also serves to enhance the structural strength of the second counterweight block tank 6.

In view of the above, the swimming pool cleaning robot according to the present invention provides a swimming pool cleaning robot with a first counterweight block in a sealed tank, without requiring an additional installation space for the first counterweight block, thereby effectively reducing the space required inside the swimming pool cleaning robot, thereby reducing the volume of the whole machine. In addition, the first counterweight block provided in the sealed tank does not require the bottom shell of the swimming pool cleaning robot to be flattened, so that the bottom shell can be designed in various shapes, which is conducive to enriching the diversity of the swimming pool cleaning robot; through the way that the first counterweight block and the second counterweight block are dispersedly arranged, the center of gravity of the whole swimming pool cleaning robot device is closer to the geometric center, so as to ensure the balance of the weight of the swimming pool cleaning robot and improve the stability of the swimming pool cleaning robot during operation; the first counterweight block tank is integrally formed with the sealed tank, and does not require an additional fixing piece; the structure is simple and the installation is convenient; the counterweight block is easy to install and the fixing method is simple and flexible.

While the foregoing is directed to embodiments of the present invention, other and further embodiments of the invention may be devised without departing from the basic scope thereof, and the scope thereof is determined by the claims that follow.

The invention claimed is:

1. A swimming pool cleaning robot comprising a bottom shell, a sealed tank and a first counterweight block, wherein the sealed tank is provided inside the bottom shell, and the first counterweight block is provided inside the sealed tank;

a first counterweight block tank provided in the sealed tank, the first counterweight block being provided in the first counterweight block tank, and the first counterweight block tank and the sealed tank are integrally processed and formed; and a circuit board assembly provided within the sealed tank.

2. The swimming pool cleaning robot according to claim 1, wherein an outside wall of the first counterweight block tank is provided with a reinforcing rib.

3. The swimming pool cleaning robot according to claim 1, further comprising a first tank cover for closing the first counterweight block tank.

4. The swimming pool cleaning robot according to claim 3, wherein the sealed tank comprises a tank body and a tank cover which are matched, an abutting column is provided on the inner side of the tank cover, and the abutting column abuts the first tank cover.

5. The swimming pool cleaning robot according to claim 1, wherein a battery pack and two motors are provided within the sealed tank, and the first counterweight block is located in the center of the area enclosed by the circuit board assembly, the battery pack, and the two motors.

6. The swimming pool cleaning robot according to claim 1, wherein the bottom shell is provided with an even number of second counterweight blocks symmetrically distributed around the center of the sealed tank.

7. The swimming pool cleaning robot according to claim 6, wherein the bottom shell is further provided with a second counterweight block tank for mounting the second counterweight block.

8. The swimming pool cleaning robot according to claim 7, further comprising a second tank cover for closing the second counterweight block tank.

9. The swimming pool cleaning robot according to claim 7, wherein a support rib is provided at the inner bottom of the second counterweight block tank, the support rib is connected to the bottom shell, and the top surface of the support rib is a support plane for contacting the second counterweight block.

* * * * *